United States Patent [19]

Clarke et al.

[11] 4,135,690

[45] Jan. 23, 1979

[54] ADJUSTABLE ANGLE FLOOR SUPPORT

[75] Inventors: Samuel C. Clarke, Andover, N.J.; Edward Losinski, Michigan City, Ind.

[73] Assignee: InterRoyal Corporation, New York, N.Y.

[21] Appl. No.: 832,765

[22] Filed: Sep. 12, 1977

Related U.S. Application Data

[63] Continuation of Ser. No. 673,247, Apr. 2, 1976, abandoned.

[51] Int. Cl.[2] ..... F16M 11/20

[52] U.S. Cl. ..... 248/188.2; 248/188.8

[58] Field of Search ..... 160/135, 351; 248/457, 248/183, 184, 185, 188.2, 188.8, 289, 291; 403/113, 117

[56] References Cited

U.S. PATENT DOCUMENTS

| | | | |
|---|---|---|---|
| 791,364 | 5/1905 | Pfeiffer et al. | 248/184 |
| 890,574 | 6/1908 | Phillips | 403/117 |
| 1,437,579 | 12/1922 | Wilson | 248/185 X |
| 1,570,576 | 1/1926 | Rivitz | 403/117 |
| 2,729,018 | 1/1956 | Morgan | 248/183 X |
| 2,896,901 | 7/1959 | Levy et al. | 248/183 |
| 3,111,723 | 11/1963 | Bates | 160/135 |
| 3,491,397 | 1/1970 | Hesener | 403/117 |

FOREIGN PATENT DOCUMENTS

| | | | |
|---|---|---|---|
| 486833 | 9/1952 | Canada | 248/183 |
| 955553 | 6/1949 | France | 160/135 |
| 1145736 | 10/1957 | France | 160/351 |
| 6089 | 3/1914 | United Kingdom | 248/457 |
| 325166 | 2/1930 | United Kingdom | 160/135 |

*Primary Examiner*—Lawrence J. Staab
*Attorney, Agent, or Firm*—Arthur A. March

[57] ABSTRACT

Adjustable angle floor support for plumb and level free standing erection of portable room divider wall and screen panels, including a lower load bearing leg section for mounting on a floor engaging foot and which has a laterally directed load bearing engagement face, an upper load transmitting leg section for receiving in load bearing relation thereon the portable room divider panel and which has a cooperating laterally directed load transmitting engagement face, and releasable positioning means, such as a transverse locking tension screw, adjustably operatively interpositioning about an axis of pivot the upper leg section on the lower leg section with the engagement faces in opposed direct load bearing releasable interengaging contact for relative angular displacement, preferably of limited range, between the leg sections about the axis of pivot for plumb and level adjustment.

13 Claims, 3 Drawing Figures

Figure 1:
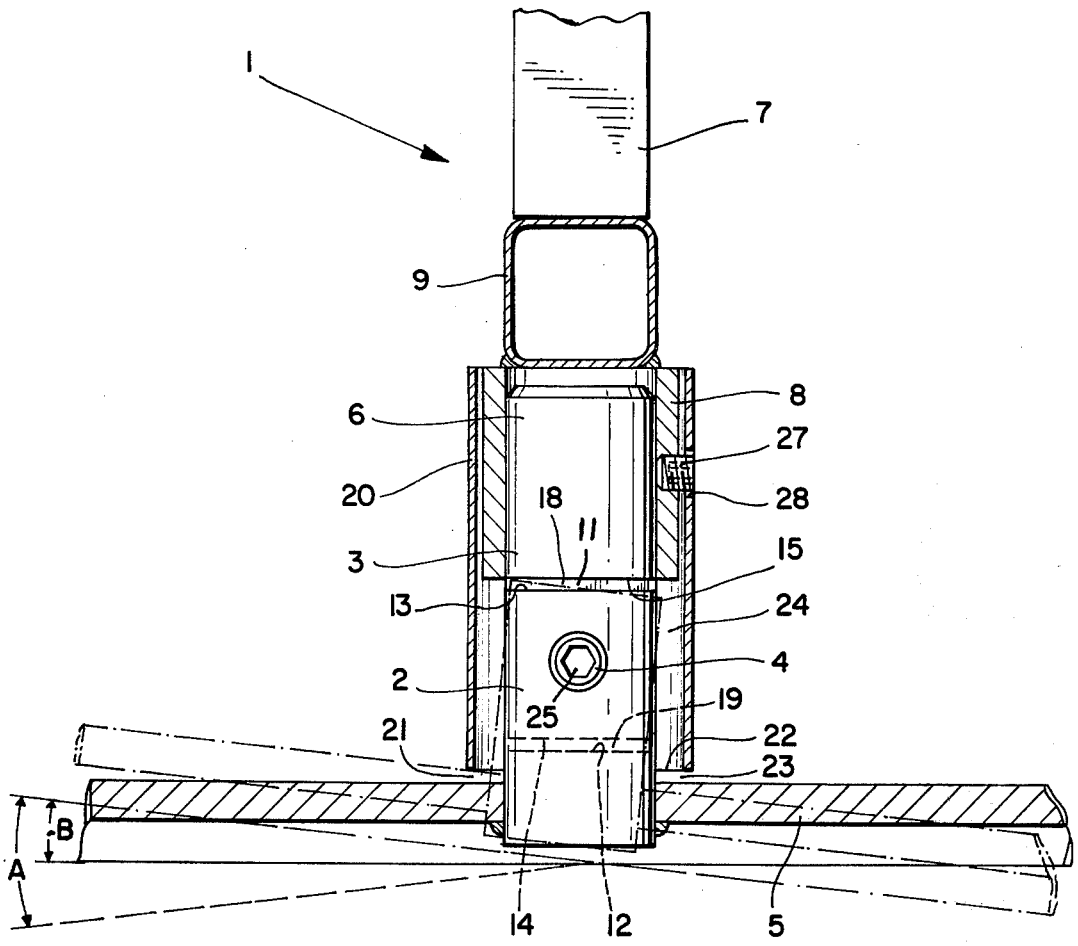

FIG. 2
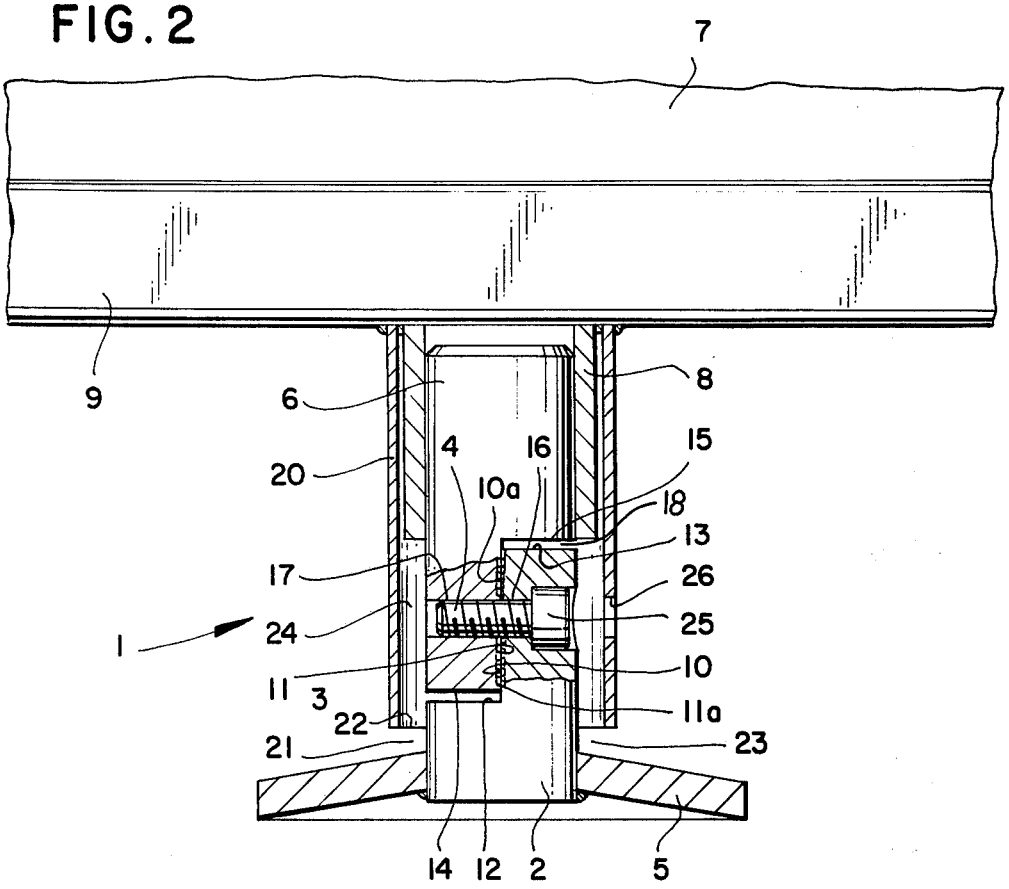
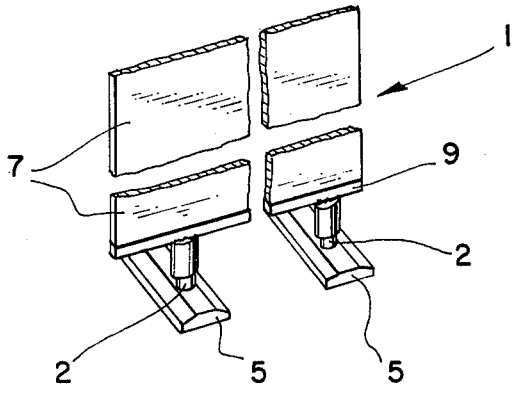
FIG. 3

ADJUSTABLE ANGLE FLOOR SUPPORT

This is a continuation, of application Ser. No. 673,247 filed on Apr. 2, 1976 now abandoned.

The present invention relates to an adjustable angle floor support for free standing portable room divider panels, and more particularly to such a floor support permitting rapid and safe plumb and level adjustment during erection of the room divider panel carried thereon.

Various floor support constructions for room divider wall and screen panels are known. However, these constructions are often unstable and thus impractical and unsafe in use, or require tedious manipulations for plumb and level adjustment in those cases where the assemblies are capable of adjustment at all, or contemplate complicated and intricate designs which are expensive to manufacture and which in turn necessitate the utilization of special machinery or parts to accomplish such manufacture. One such known construction employs screw type adjustable glides to raise the divider panel to a perpendicular position but at the expense of simultaneously raising the corresponding floor engaging foot an equivalent amount off the floor, so as to render the assembly subject to an inherent tripping hazard due to the corresponding change in floor to floor engaging foot angulation.

It is among the objects of the present invention to overcome the foregoing drawbacks and to provide a novel adjustable angle floor support for selective plumb and level free standing erection of portable room divider panels, especially of the acoustical wall and screen variety, which is simple, rugged and durable in construction, employing a minimum of cooperating parts, which is inexpensive and easy to manufacture, utilizing readily available and economically competitive manufacturing machinery and parts, and which is versatile and adaptable in use.

It is among the further objects of the invention to provide such a floor support which permits rapid and easy assembly and knock down, plumb and level adjustment, and room divider panel portable repositioning and re-erection, and which is safe and sure in use for accomplishing stable, self-supporting and free standing erection and disposition of such room divider panels without inherent tripping hazards or inadvertent tipping or imbalance despite deviations of the supporting floor from true horizontal.

Other and further objects of the invention will become apparent from a study of the within specification and accompanying drawing, in which FIG. 1 is a schematic partial sectional end view of the adjustable angle floor support of the invention showing its disposition on a portion of a floor engaging foot and the selective limited range of angular adjustment between the load bearing coacting parts, FIG. 2 is a schematic partial sectional side view of the floor support shown in FIG. 1 correspondingly rotated 90 degrees in orientation, and FIG. 3 is a schematic perspective view on a reduced scale showing a pair of floor supports of the invention in an assembly carrying a portable room divider panel in free standing erect load bearing relation thereon.

Broadly, the present invention contemplates an adjustable angle plumb and level floor support for free standing portable room divider panels, such as those of the acoustical wall or screen panel type, which comprises a lower load bearing leg section having a laterally directed load bearing engagement face and adapted to be mounted on a floor engaging foot, an upper load transmitting leg section having a cooperating laterally directed load transmitting engagement face and adapted to receive in load bearing relation thereon a portable room divider panel, and releasable positioning means adjustably operatively interpositioning about an axis of pivot the upper leg section on the lower leg section with said engagement faces in opposed direct load bearing releasable interengaging contact for relative angular displacement between the leg sections about the axis of pivot for plumb and level adjustment.

Coacting means are preferably included to limit selectively the range of such relative angular displacement between the two leg sections. Such coacting means may include a downwardly directed abutment shoulder on said upper leg section and an upwardly directed abutment shoulder on said lower leg section spaced from each other a corresponding selective distance sufficient to provide an articulating abutment gap therebetween to limit the range of relative angular displacement between the leg sections upon relative articulation of such shoulders about the pivot axis to close such abutment gap. Alternatively or additionally, such coacting means may include a longitudinal impingement sleeve positioned in captively enclosing selectively spaced operative relation with respect to the leg sections for impingement to limit the range of relative angular displacement between said leg sections.

The releasable positioning means may conveniently take the form of a locking tension screw operatively articulatingly interconnecting the leg sections for such adjustable angular displacement about the screw axis. In accordance with the preferred embodiment, advantageously the corresponding engagement faces of the leg sections may be provided as roughened friction engagement abutting surfaces, such as knurled surfaces, to prevent relative displacement thereat under the positive interconnecting force of the tension screw.

More specifically, the leg sections may be provided in overlapping rabbet relation articulatingly interconnected by such locking tension screw. Thus, the lower leg section may have a laterally directed longitudinal load bearing engagement face medially bounded by an upwardly directed transverse intermediate abutment shoulder and terminally bounded by an upwardly directed transverse end abutment shoulder. Correspondingly, the upper leg section may have a cooperating laterally directed longitudinal load transmitting engagement face medially bounded by a downwardly directed transverse intermediate abutment shoulder and terminally bounded by a downwardly directed transverse end abutment shoulder.

In this regard, the lower leg section end shoulder will be disposed in opposed relation to the upper leg section intermediate shoulder and form therewith one set of opposed shoulders, whereas the upper leg section end shoulder will be disposed in opposed relation to the lower leg section intermediate shoulder and form therewith another set of opposed shoulders. Preferably, the opposed shoulders of at least one of such sets are longitudinally spaced apart a selective distance sufficient to provide a corresponding articulating gap therebetween to limit selectively the range of relative angular displacement between the leg sections upon relative articulation of the opposed shoulders of such set about the pivot axis to close the corresponding gap and cause impingement between such opposed shoulders.

On the other hand, alternatively or additionally, a longitudinal impingement sleeve may be provided which downwardly depends from the room divider panel and terminates a selective distance above the floor engaging foot to provide an articulating impingement gap therebetween. Such sleeve will be positioned in captively enclosing selectively spaced operative relation with respect to the leg sections for impingement against the adjacent portion of the floor engaging foot to limit the range of relative angular displacement between the leg sections upon corresponding articulation of the sleeve and foot about the pivot axis to close the impingement gap.

Referring to the drawing, an adjustable angle plumb and level floor support arrangement 1 is shown for operatively carrying a free standing portable room divider panel, such as an acoustical wall or screen penal of conventional variety, including lower load bearing leg section 2, upper load transmitting leg section 3 and releasable positioning means, for example in the form of locking tension screw 4, disposed on an elongated floor engaging foot 5.

Foot 5 may be of the standard type and size and its purpose is to maintain direct structural contact with the room floor or any other supporting surface on which the room divider panel is to be portably rested. Lower leg section 2 may be mounted perpendicularly on foot 5 by means of a welded joint connection, or by means of a removable screw (not shown) for example upwardly engaging lower leg section 2 through an underside portion of the foot, or by any other fixed or removable or knock down means, so long as an operative mounting of the lower leg section more or less vertically in load bearing relation on the foot is achieved for the intended purposes.

The top end 6 of upper leg section 3 is adapted to receive removably the room divider panel 7 more or less vertically in load bearing relation thereon, for example via a captive cup-like socket 8. Socket 8 is connected in turn to the room divider panel proper thereabove, for example by welding to the bottom portion of the frame 9 thereof, and is sized for slip fit or friction engagement downwardly over said top end 6.

Lower leg section 2 is provided with a laterally directed load bearing engagement face 10 and upper leg section 3 is correspondingly provided with a cooperating laterally directed load transmitting engagement face 11.

By reason of the releasable positioning means, here exemplified in the form of a locking tension screw 4, adjustable operative interpositioning of the upper leg section 3 more or less vertically on lower leg section 2, e.g. in partial overlapping relation at the engagement faces 10 and 11, is effected, such that generally the adjacent end portions of the legs are maintained in opposed selectively vertically spaced apart corresponding operative nonload bearing relation while the engagement faces 10 and 11 are maintained in continuous opposed direct load bearing releasable interengaging contact along their common extent for relative angular displacement between the leg sections about the more or less substantially horizontal pivot axis of the tension screw 4. Simple and rapid plumb and level adjustment are thereby made possible for attaining accurate perpendicular or vertical positioning of the room divider panel, regardless of deviations between the pitch or contour of the floor or other supporting surface and true horizontal.

It will be realized that although the releasable positioning means, e.g. screw 4, operatively articulatingly interconnects the leg sections, such screw merely serves to maintain the coacting overlapping parts in continuous direct load bearing relation and is not itself intended to receive and transmit the positive load of the room divider panel. This function is performed by the cooperating compressive interengaging contact continuously maintained directly between the two leg sections at the opposed lateral engagement faces. Such mechanism is comparable to a knee joint type construction in which the pivot axis is relieved of positive load by the agency of compressive contact bearing surfaces peripheral thereto.

In this regard, the leg sections are preferably disposed in operative overlapping rabbet form. Lower leg section 2 in this instance is desirably provided with a laterally directed longitudinal load bearing engagement face 10 medially bounded by an upwardly directed transverse intermediate abutment shoulder 12 and terminally bounded by an upwardly directed transverse end abutment shoulder 13.

Correspondingly, upper leg section 3 in this instance is desirably provided with a cooperating laterally directed longitudinal load transmitting engagement face 11 medially bounded by a downwardly directed transverse intermediate abutment shoulder 14 and terminally bounded by a downwardly directed transverse end abutment shoulder 15.

Aligned locking tension screw receiving and accommodating transverse apertures 16 and 17 are provided correspondingly in lower leg section 2 and upper leg section 3 which accordingly define the axis of angular displacement between the two leg sections. Thus, the locking screw 4 is able to operatively articulatingly interconnect about its axis the leg sections 2 and 3 transversely via apertures 16 and 17 with faces 10 and 11 in continuous direct load bearing releasable compressive interengaging contact. Such axis is normally disposed as a horizontal axis of pivot considering the positional orientation of the coacting parts and their plumb and level adjustment purpose.

The selective transverse width dimension of the opposed engagement faces along their common extent is generally sufficient to carry the positive load thereon in a stable manner essentially without transmitting such load onto the tension screw, so that the screw in effect merely utilizes its selective tension reserve to keep the overlapping portions of the two leg sections in friction engagement along the abutting portions of the engagement faces 10 and 11. This effect is enhanced by providing one or both of faces 10 and 11 with roughened friction engagement surfaces, e.g. knurled surfaces **10*a* and 11*a***, to prevent relative displacement thereat under the positive compressive interconnecting force of the tension screw.

As may be seen in FIG. 2, lower leg section end shoulder 13 is positioned in opposed relation to upper leg section intermediate shoulder 15 and forms therewith one set of opposed shoulders, whereas upper leg section end shoulder 14 is positioned in opposed relation to lower leg section intermediate shoulder 12 and likewise forms therewith another set of opposed shoulders. The opposed shoulders of at least one of these sets are desirably longitudinally spaced apart a selective distance sufficient to provide a corresponding articulating gap 18 and/or 19 therebetween.

This distance separating these coacting means will in turn selectively limit the range of relative angular displacement between the leg sections, as illustrated by the larger double arrow A in FIG. 1, upon relative articulation of the opposed shoulders 13 and 15 and/or 12 and 14 of the appropriate set of such coacting means about the axis of screw 4 to close the corresponding gap and cause impingement between such set of opposed shoulders. Such gap can be adjusted to change the angular range limit by the provision of shims (not shown) inserted removably in the spacing between shoulders 13 and 15 and/or 12 and 14, as the artisan will appreciate.

Thus, in effect, as shown in phantom in FIG. 1, for example, shoulder 13 will rock about the axis of screw 4 to impinge at one or the other corner thereof against the portion of shoulder 15 coming within its extreme range thereat when screw 4 is loosened for angular adjustment of engagement faces 10 and 11 and in turn lower and upper leg sections 2 and 3 with respect to each other to achieve plumb (true vertical) and level (true horizontal) positioning of the room divider panel on the floor supporting foot or feet, as the case may be.

It will be appreciated that the narrower of the two gaps 18 and 19, if they be unequal, will generally govern the range of relative angular displacement between the leg sections because the half amplitude rocking angle, as illustrated by the smaller double arrow B in FIG. 1, will be directly dependent thereon. Normally, however, the gaps 18 and 19 will be of equivalent operative gap spacing so that more balanced and comprehensive control of the rocking limits of the leg sections will be achieved.

More specifically, where the selective distance defining such gaps in the same, in terms of the orientation shown in FIG. 1, the left corner of lower leg section end shoulder 13 will upwardly impinge against the left portion of upper leg section intermediate shoulder 15 coming within its extreme range thereat and simultaneously the left corner of lower leg section intermediate shoulder 12 will upwardly impinge against the left portion of upper leg section end shoulder 14 coming within its extreme range thereat, during half amplitude rocking of foot 5 to the left. Correspondingly, the right corner of lower leg section end shoulder 13 will upwardly impinge against the right portion of upper leg section intermediate shoulder 15 coming within its extreme range thereat and simultaneously the right corner of lower leg section intermediate shoulder 12 will upwardly impinge against the right portion of upper leg section end shoulder 14 coming within its extreme range thereat, during half amplitude rocking of foot 5 to the right.

Preferably, the controlling selective gap distance will be such that the corresponding half amplitude rocking angle represented by arrow B amounts to about 6 degrees and in turn the full range amplitude rocking angle represented by arrow A amounts to about 12 degrees. This will generally assure that the floor support system in extreme angular position will still be capable of static disposition and equilibrium, whether such extreme position is a consequence of intended angular adjustment or accident.

Apart from the foregoing coacting means or stop means employing at least one set of opposed shoulders, a longitudinal impingement sleeve 20 may be independently or alternatively or additionally provided to limit selectively the range of such relative angular displacement between the two leg sections. Sleeve 20 desirably downwardly depends from the room divider panel 7, for example being attached by welding to the bottom portion of frame 9 thereof, and terminates a selective distance above the floor engaging foot 5. This selective distance provides an independent articulating impingement gap 21 between the lower end of sleeve 20 and the adjacent upper portion of foot 5. Also, by reason of its generally concentric disposition about socket 8, sleeve 20 captively encloses the two leg sections and is positioned in selectively spaced operative relation with respect thereto.

Sleeve 20 is thus selectively dimensioned and positioned for impingement at its lower end 22 against the adjacent portion 23 of foot 5 within the range of gap 21 whereby to limit the range of relative angular displacement between the two leg sections upon corresponding articulation of sleeve 20 and foot 5 about the axis of tension screw 4 to close impingement gap 21. This range desirably likewise corresponds to the half amplitude rocking angle of about 6 degrees represented by arrow B and in turn the full range amplitude rocking angle of about 12 degrees represented by arrow A.

It will be further realized that apart from the separate and independent coacting means or stop means represented by the at least one set of opposed shoulders 13 and 15 and/or 12 and 14, and represented by sleeve 20 and foot 5, as aforesaid, sleeve 20 may also constitute such coacting means or stop means together with the two leg sections themselves. Specifically, by reason of the generally concentric disposition and suitable dimensioning of sleeve 20 in captively enclosing selectively spaced operative relation with respect to leg sections 2 and 3, a corresponding intermediate or annular gap 24 is defined therebetween. Thus, even if abutment gaps 18 and 19 and impingement gap 21, and their corresponding defining structure, were omitted or of larger gap spacing than annular gap 24, the range of relative angular displacement between the leg sections would still be governed by the limits of gap 24.

In the latter instance, in terms of the orientation shown in FIG. 1, structure corresponding to the right corner of lower leg section end shoulder 13 will downwardly impinge against the right adjacent inside wall portion of sleeve 20 coming within its extreme range thereat, during half amplitude rocking of foot 5 to the left, and structure corresponding to the left corner of lower leg section end shoulder 13 will downwardly impinge against the left adjacent inside wall portion of sleeve 20 coming within its extreme range thereat, during half amplitude rocking of foot 5 to the right. Alternatively, depending on the relative dimensioning of the length of sleeve 20 with respect to the axis of tension screw 4 in terms of the distance represented by annular gap 24, the left side of lower leg section 2 will upwardly impinge against the left adjacent lower end portion of sleeve 20 coming within its extreme range thereat, during half amplitude rocking of foot 5 to the left, and the right side of lower leg section 2 will upwardly impinge against the right adjacent lower end portion of sleeve 20 coming within its extreme range thereat, during half amplitude rocking of foot 5 to the right.

Of course, by providing all of the various gaps and their corresponding defining structure of equivalent operative dimensions and spacing, simultaneous cooperating coacting means or stop means may be desirably provided, collectively limiting the range of relative angular displacement between the leg sections about the axis of tension screw 4. By way of such range limiting structure, imbalance and accidental tipping of the so supported room divider wall or screen panel or the like will be prevented, yet plumb and level adjustment will be able to be conveniently and rapidly carried out.

In this regard, tension screw 4 is preferably provided with a tightening tool engagable head 25 yet advantageously is captively positioned within sleeve 20. Appropriately, sleeve 20 is correspondingly provided with a tool access opening 26 of size and configuration sufficient for insertion of a tightening tool to engage screw head 25 yet insufficient for removal of tension screw 4 therethrough (see FIG. 2). Thus, tension screw 4 may be readily released from locking interengagement of leg sections 2 and 3 to permit plumb and level adjustment to be undertaken and again tightened to provide such locking interengagement without fear of tension screw 4 becoming inadvertently removed or the room divider wall or screen panel accidently tipping over.

To mount the room divider panel 7 operatively on upper leg section 3 via longitudinal retaining socket 8, which downwardly depends from frame 9 within sleeve 20 and terminates a selective distance above the upper portion of lower leg section 2, a set screw 27 is provided. Socket 8 is operatively embracively received in load bearing relation on the top end 6 of upper leg section 3, and set screw 27 is operatively positioned in socket 8 for releasably engaging top end 6 to insure a locking connection thereat. Sleeve 20 is correspondingly provided with a set screw access opening 28 to permit setting of such set screw 27 (see FIG. 1).

Of course, by selectively limiting the angular range via one or more of the above coacting means or stop means, in dependence upon the dimensions, load distribution and center of gravity of the particular room divider panel 7 (see FIG. 3), and also in dependence upon the overall center of gravity of the entire assembly, considering the dimensions of the particular floor engaging foot, the entire assembly can be provided in a form which will insure that even in the worst possible angular condition during plumb and level adjustment or otherwise the room divider panel will not tip over, but will remain self-supporting and free standing. Generally, it will be realized that for maximum stability, a pair of floor support arrangements 1 will be provided for carrying a particular room divider panel as shown in the overall assembly of FIG. 3.

Thus, the present invention provides a simple, rugged and durable construction, employing a minimum of cooperating parts, and one which is inexpensive and easy to manufacture, especially in terms of the selective dimensions of the various possible angular range limiting coacting means or stop means. The various parts of the overall assembly can be rapidly made up and knocked down for repositioning and reassembly with safety. In particular, adjustment for plumb or true vertical and for level or true horizontal can be rapidly and safely effected simultaneously by merely loosening a tension screw, yet intentional or unintentional angular displacement to the extremes of the selected limits of relative angular movement between the leg sections will not result in tipping of the assembly.

It will be realized that the foregoing specification and drawing have been set forth by way of illustration and not limitation, and that various modifications and changes may be made therein without departing from the spirit and scope of the present invention which is to be limited solely by the scope of the appended claims.

What is claimed is:

1. Adjustable angle plumb and level floor support for free standing portable room divider panels comprising:

a lower load bearing leg section having an upwardly directed end portion provided with a laterally directed load bearing engagement face and adapted to be mounted on a floor engaging foot, an upper load transmitting leg section having a downwardly directed end portion provided with a cooperating laterally directed load transmitting engagement face and adapted to receive in load bearing relation thereon a portable room divider panel, releasable positioning means adjustably operatively interpositioning about an axis of pivot said upper leg section on said lower leg section in partial overlapping relation at said faces and with said faces in opposed lateral direct load bearing releasable interengaging contact substantially along their common extent and with the remainder of said end portions operatively spaced from each other and disposed out of direct load bearing contact with each other, for relative angular displacement between said leg sections about said axis at said faces for plumb and level adjustment, and a longitudinal impingement sleeve positioned in captively enclosing selectively spaced operative relation with respect to said leg sections for impingement to limit selectively the range of relative angular displacement between said leg sections.

2. Support according to claim 1 wherein said lower leg section is mounted operatively on a floor engaging elongated foot.

3. Support according to claim 1 wherein a portable room divider panel is received operatively in load bearing relation on said upper leg section.

4. Support according to claim 1 wherein said releasable positioning means include a releasable positioning locking tension screw operatively articulatingly interconnecting said leg sections.

5. Support according to claim 4 wherein the corresponding engagement faces of said leg sections are provided as roughened friction engagement surfaces to prevent relative displacement thereat under the positive interconnecting force of the tension screw.

6. Support according to claim 5 wherein said friction engagement surfaces are knurled surfaces.

7. Adjustable angle plumb and level floor support for free standing portable room divider panels comprising:

a lower load bearing leg section having an upwardly directed end portion provided with a laterally directed load bearing engagement face and a transverse shoulder portion and adapted to be mounted on a floor engaging foot, an upper load transmitting leg section having a downwardly directed end portion provided with a cooperating laterally directed load transmitting engagement face and a transverse shoulder portion and adapted to receive in load bearing relation thereon a portable room divider panel, releasable positioning means adjustably operatively interpositioning about an axis of pivot said upper leg section on said lower leg section in partial overlapping relation at said faces and with said shoulder portions in opposed selectively vertically spaced apart corresponding facing relation and said faces in opposed lateral direct load bearing releasable interengaging contact substantially along their common extent for relative angular displacement between said leg sections about said axis for plumb and level adjustment, and a longitudinal impingement sleeve positioned in captively enclosing selectively spaced operative relation with respect to said leg sections for impingement to limit selectively the range of relative angular displacement between said leg sections.

8. Adjustable angle plumb and level floor support for free standing portable room divider panels comprising:

a floor engaging elongated foot, a lower load bearing leg section operatively mounted on said foot and having an upwardly directed end portion provided with a laterally directed load bearing engagement face, an upper load transmitting leg section having a downwardly directed end portion provided with a cooperating laterally directed load transmitting engagement face, a portable room divider panel operatively received in load bearing relation on said upper leg section, releasable positioning means adjustably operatively interpositioning about an axis of pivot said upper leg section on said lower leg section in partial overlapping relation at said faces and with said faces in opposed lateral direct load bearing releasable interengaging contact substantially along their common extent and with the remainder of said end portions operatively spaced from each other and disposed out of direct load bearing contact with each other for relative angular displacement between said leg sections about said axis for plumb and level adjustment, and a longitudinal impingement sleeve downwardly depending from said room divider panel and terminating a selective distance above said floor engaging foot to provide an articulating impingement gap therebetween and positioned in captively enclosing selectively spaced operative relation with respect to said leg sections for impingement against the adjacent portion of said floor engaging foot to limit selectively the range of relative angular displacement between said leg sections upon corresponding relative articulation of said sleeve and foot about said axis to close said impingement gap.

9. Support according to claim 8 wherein a downwardly directed abutment shoulder is included on said upper leg section and an upwardly directed abutment shoulder is included on said lower leg section spaced from each other a corresponding selective distance sufficient to provide an articulating abutment gap therebetween to limit selectively independently the range of relative angular displacement between said leg sections upon relative articulation of said shoulders about said axis to close said abutment gap.

10. Support according to claim 9 wherein said releasable positioning means include a releasable positioning locking tension screw operatively articulatingly interconnecting said leg sections.

11. Adjustable angle plumb and level floor support for free standing portable room divider panels comprising:

a floor engaging elongated foot, a lower load bearing leg section operatively mounted on said foot and having a laterally directed longitudinal load bearing engagement face medially bounded by an upwardly directed transverse intermediate abutment shoulder and terminally bounded by an upwardly directed transverse end abutment shoulder, an upper load transmitting leg section having a cooperating laterally directed longitudinal load transmitting engagement face medially bounded by a downwardly directed transverse intermediate abutment shoulder and terminally bounded by a downwardly directed transverse end abutment shoulder, a portable room divider panel operatively received in load bearing relation on said upper leg section, said leg sections being adjustably operatively interpositioned in corresponding overlapping rabbet form with said upper leg section on said lower leg section in partial overlapping relation at said faces, and with said faces in opposed lateral direct load bearing releasable interengaging contact substantially along their common extent for relative angular displacement between said leg sections about a substantially horizontal axis of pivot, and with said lower leg section end shoulder in opposed relation to said upper leg section intermediate shoulder and forming one set of opposed shoulders and said upper leg section end shoulder in opposed relation to said lower leg section intermediate shoulder and forming another set of opposed shoulders and correspondingly with the opposed shoulder of at least one of said sets longitudinally spaced apart a selective distance sufficient to provide a corresponding articulating gap therebetween to limit selectively the range of relative angular displacement between said leg sections upon relative articulation of the opposed shoulders of such set about said axis to close the corresponding gap and cause impingement between said opposed shoulders, corresponding aligned locking tension screw receiving transverse apertures in said leg sections and defining the axis of angular displacement between said leg sections, a releasably positioning locking tension screw operatively received in said apertures and articulatingly interconnecting said leg sections about said axis with said faces in releasable compressive interengaging contact, and a longitudinal impingement sleeve downwardly depending from said room divider panel and terminating a selective distance about said floor engaging foot to provide an articulating impingement gap therebetween and positioned in captively enclosing selectively spaced operative relation with respect to said leg sections for impingement against the adjacent portion of said floor engaging foot to limit selectively independently the range of relative angular displacement between said leg sections upon corresponding articulation of said sleeve and foot about said axis to close said impingement gap.

12. Support according to claim 11 wherein the corresponding engagement faces of said leg sections are provided as roughened friction engagement surfaces to prevent relative displacement thereat under the positive interconnecting force of the tension screw, said tension screw is provided with a tightening tool engageable head and is captively positioned within said sleeve, and said sleeve is correspondingly provided with a tool access opening of size sufficient for insertion of a tightening tool to engage said screwhead yet insufficient for removal of said tension screw.

13. Support according to claim 12 wherein a longitudinal retaining socket is provided which downwardly depends from said room divider panel within said sleeve and terminates a selective distance above the upper portion of said lower leg section and which is operatively embracively received in load bearing relation on the upper portion of said upper leg section, a set screw is operatively positioned in said socket for releasably engaging the upper portion of said upper leg section, and said sleeve is correspondingly provided with a set screw access opening to permit setting of said set screw.

* * * * *